US010641229B2

(12) United States Patent
Ono

(10) Patent No.: US 10,641,229 B2
(45) Date of Patent: May 5, 2020

(54) ELECTROMAGNETIC SWITCH DEVICE FOR STARTER

(71) Applicant: Mitsubishi Electric Corporation, Tokyo (JP)

(72) Inventor: Takuma Ono, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 19 days.

(21) Appl. No.: 16/070,835

(22) PCT Filed: Apr. 27, 2016

(86) PCT No.: PCT/JP2016/063196
§ 371 (c)(1),
(2) Date: Jul. 18, 2018

(87) PCT Pub. No.: WO2017/187554
PCT Pub. Date: Nov. 2, 2017

(65) Prior Publication Data

US 2019/0048840 A1 Feb. 14, 2019

(51) Int. Cl.
*F02N 11/08* (2006.01)
*H01H 51/06* (2006.01)
(Continued)

(52) U.S. Cl.
CPC ..... *F02N 11/087* (2013.01); *F02N 11/08* (2013.01); *F02N 15/006* (2013.01); *H01H 47/22* (2013.01);
(Continued)

(58) Field of Classification Search
CPC ..... F02N 11/087; F02N 11/08; F02N 15/006; F02N 11/00; F02N 2011/0892;
(Continued)

(56) References Cited

U.S. PATENT DOCUMENTS 5,677,656 A 10/1997 Mauch et al.
5,909,067 A 6/1999 Liadakis
(Continued)

FOREIGN PATENT DOCUMENTS

DE 19735326 A1 3/1998
EP 1203884 A2 5/2002
(Continued)

OTHER PUBLICATIONS

Communication dated Mar. 29, 2019 from the European Patent Office in application No. 16900426.4.

*Primary Examiner* — Mohamad A Musleh
(74) *Attorney, Agent, or Firm* — Sughrue Mion, PLLC; Richard C. Turner

(57) ABSTRACT

An electromagnetic switch device for a starter includes: a terminal block in which a main contact chamber that is open at an attraction coil side in an axial direction and in which a pair of main fixed contacts and a main movable contact are located, and an auxiliary relay that is open at a side opposite to the attraction coil side in the axial direction, are located; a cover provided at an opening side of the terminal block at which the auxiliary relay is located, the cover having through holes through which main fixed contacts penetrate in a state where the auxiliary relay is sealed; and an elastic member which is located between the auxiliary relay and the cover and which fixes the auxiliary relay in the axial direction together with the terminal block and the cover.

20 Claims, 8 Drawing Sheets

(51) Int. Cl.

| | |
|---|---|
| ***H01H 50/04*** | (2006.01) |
| ***F02N 15/00*** | (2006.01) |
| ***H01H 47/22*** | (2006.01) |
| ***H01H 50/02*** | (2006.01) |
| *F02N 11/00* | (2006.01) |

(52) U.S. Cl.
CPC ..... *H01H 50/02* (2013.01); *H01H 50/04* (2013.01); *H01H 51/06* (2013.01); *H01H 51/065* (2013.01); *F02N 11/00* (2013.01); *F02N 2011/0892* (2013.01); *H01H 2050/049* (2013.01)

(58) Field of Classification Search
CPC ..... H01H 47/22; H01H 50/02; H01H 50/04; H01H 51/06; H01H 51/065; H01H 2050/049
See application file for complete search history.

(56) References Cited

U.S. PATENT DOCUMENTS

| | | | |
|---|---|---|---|
| 2002/0053961 | A1 | 5/2002 | Kajino |
| 2009/0002105 | A1 | 1/2009 | Bradfield et al. |
| 2010/0033066 | A1 | 2/2010 | Murata et al. |
| 2012/0119497 | A1 | 5/2012 | Murata et al. |
| 2018/0005790 | A1 | 1/2018 | Morimoto |

FOREIGN PATENT DOCUMENTS

| | | | | |
|---|---|---|---|---|
| EP | 2151573 | A2 | 2/2010 | |
| EP | 3282465 | A1 | 2/2018 | |
| FR | 2752998 | A1 * | 3/1998 | ..... F02N 11/087 |
| JP | 08-504913 | A | 5/1996 | |
| JP | 2002-138931 | A | 5/2002 | |

* cited by examiner

ELECTROMAGNETIC SWITCH DEVICE FOR STARTER

CROSS REFERENCE TO RELATED APPLICATIONS

This application is a National Stage of International Application No. PCT/JP2016/063196, filed Apr. 27, 2016.

TECHNICAL FIELD

The present invention relates to an electromagnetic switch device for a starter, used for a starter for starting an engine provided to an automobile, for example.

BACKGROUND ART

Conventionally, an electromagnetic switch device for a starter, used for a starter for starting a large-displacement engine of, in particular, a bus or a truck, needs to be supplied with a large current in order to cause the electromagnetic switch device for a starter to operate, and a relay called an auxiliary relay, which has a smaller size than the electromagnetic switch device for a starter, is used as a current supplying means therefor.

The auxiliary relay is provided near the electromagnetic switch device for a starter and is connected via wires so as to form an electric circuit. However, it is often difficult to ensure a space for providing the auxiliary relay in an engine chamber, and it is also often difficult to arrange the wires. Therefore, an electromagnetic switch device for a starter is known which includes an auxiliary relay for which such a space and such wires are not needed (for example, Patent Documents 1 to 3).

The embodiment in FIG. 1 in Patent Document 1 and the embodiments in Patent Documents 2 and 3 each disclose an electromagnetic switch device for a starter in which an auxiliary relay is provided between a solenoid coil and a movable contact.

The embodiment in FIG. 5 in Patent Document 1 discloses an electromagnetic switch device for a starter in which an auxiliary relay is provided such that a part thereof protrudes outward in the axial direction from a terminal block.

CITATION LIST

Patent Document

Patent Document 1: US2009/0002105 A1

Patent Document 2: Japanese Laid-Open Patent Publication No. 2002-138931

Patent Document 3: Japanese Translation of PCT International Application Publication No. 8-504913

SUMMARY OF THE INVENTION

Problems to be Solved by the Invention

However, in the embodiment in FIG. 1 in Patent Document 1 and the embodiments in Patent Documents 2 and 3, the solenoid coil of the auxiliary relay is wound around the outer circumference of the movable contact of the electromagnetic switch device for a starter, and therefore the development length of the coil is increased.

When the development length of the coil is increased, the coil resistance is increased, resulting in a problem in that it is impossible to supply a current needed for the auxiliary relay to operate.

In order to solve this problem, it is necessary to increase the sectional area of the coil element wire of the solenoid coil of the auxiliary relay, resulting in a problem in that the size of the solenoid coil of the auxiliary relay is increased and the manufacturing cost is increased.

In the embodiment in FIG. 5 in Patent Document 1, the auxiliary relay is provided so as to protrude in the axial direction, thereby solving the problems wherein the size of the solenoid coil of the auxiliary relay and the manufacturing costs are increased. However, when the auxiliary relay protrudes in the axial direction, vehicle mountability is deteriorated.

Furthermore, since the auxiliary relay is located at a position away from the engine attachment surface of the starter, vibration response is increased, resulting in a problem in that vibration resistance is deteriorated.

The present invention has been made to solve the above problems, and an object of the present invention is to provide an electromagnetic switch device for a starter in which an auxiliary relay is provided and which has excellent vibration resistance and low cost.

Solution to the Problems

An electromagnetic switch device for a starter according to the present invention includes:

an electromagnetic switch which includes a pair of main fixed contacts, a main movable contact, and a main coil, which opens and closes an electric circuit for a motor via the pair of main fixed contacts, and which engages a pinion with a ring gear via a shift lever when the main coil is energized;

an auxiliary relay which includes a pair of sub fixed contacts, a sub movable contact, and a sub coil, the pair of sub fixed contacts being connected to the main coil of the electromagnetic switch, the auxiliary relay energizing the main coil of the electromagnetic switch via the pair of sub fixed contacts in response to a start signal;

a terminal block in which a main contact chamber that is open at the main coil side in an axial direction and in which the pair of main fixed contacts and the main movable contact are located, and the auxiliary relay that is open at a side opposite to the main coil side in the axial direction, are located;

a cover located at an opening side of the terminal block at which the auxiliary relay is located, the cover having through holes through which the main fixed contacts penetrate in a state where the auxiliary relay is sealed; and an elastic member which is located between the auxiliary relay and the cover and which fixes the auxiliary relay in the axial direction together with the terminal block and the cover.

Effect of the Invention

In the electromagnetic switch device for a starter according to the present invention, since the elastic member which fixes the auxiliary relay in the axial direction is located between the cover and the auxiliary relay, the effect that vibration resistance is improved without deterioration of the assemblability of the electromagnetic switch device for a starter is obtained.

DESCRIPTION OF EMBODIMENTS

Figure 1:
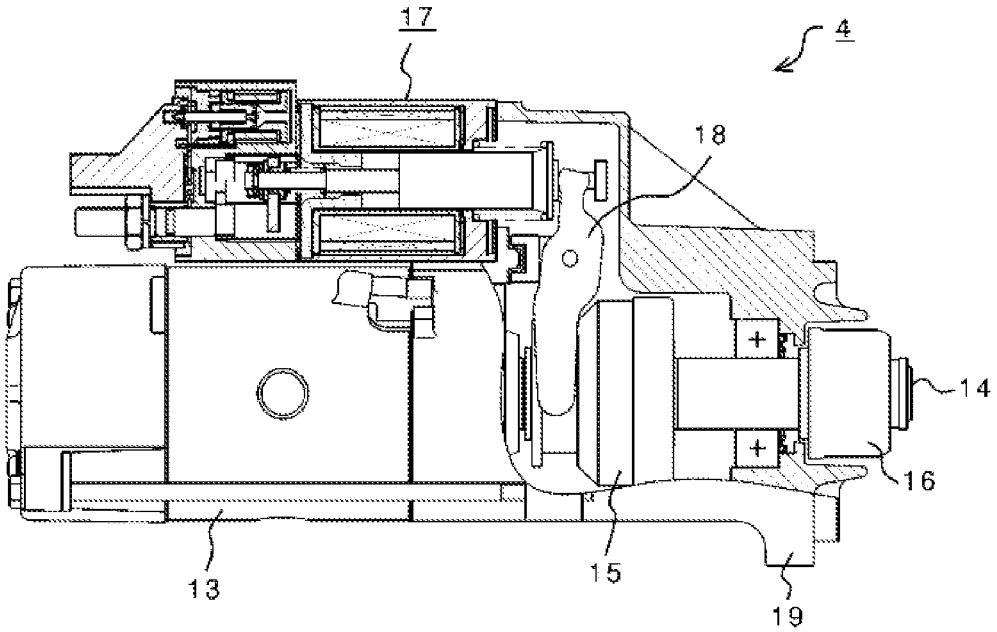
FIG. 1 is a partial cross-sectional view of a starter equipped with an electromagnetic switch device for a starter according to Embodiment 1 of the present invention.
Figure 2:
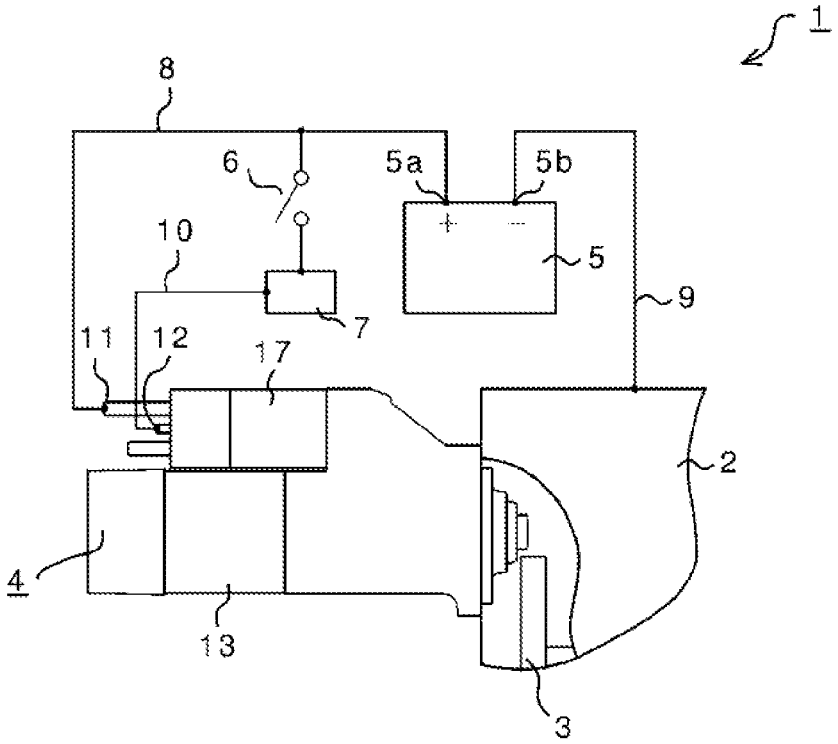
FIG. 2 is a schematic diagram of an internal combustion engine device according to Embodiment 1 of the present invention.

In FIG. 1 to FIG. 10A-10F, an internal combustion engine device 1 includes an engine 2, a ring gear 3, a starter 4, a battery 5, a key switch 6, a control device 7, a battery positive wire 8, a battery negative wire 9, and an S circuit wire 10.

The engine 2 is an internal combustion engine, and since the engine 2 cannot start by itself, the engine 2 starts self-rotation by receiving rotational force from the starter 4 via the ring gear 3.

The ring gear 3 transmits the rotational force from the starter 4 to the engine 2, and is directly connected to the engine 2.

The starter 4 generates rotational force by power from the battery 5, and transmits the rotational force to the engine 2 via the ring gear 3.

The battery 5 is a secondary battery which has stored power for rotating the starter 4, and is electrically connected to the starter 4 via the battery positive wire 8 and the battery wire 9.

The key switch 6 causes the starter 4 to rotate when turned on, and causes the starter 4 to stop when turned off.

The control device 7 performs overall determination as to the ON/OFF state of the key switch 6 and other start conditions, and transmits a start signal to the starter 4.

The battery positive wire 8 connects a battery positive terminal 5*a* of the battery 5 and a battery terminal 11 of the starter 4 to each other, and the battery negative wire 9 is connected to a battery negative terminal 5*b* and the engine 2, whereby the battery 5 and the starter 4 are electrically connected to each other.

The S circuit wire 10 is a wire electrically connecting the control device 7 and an S terminal 12 of the starter 4 to each other.

Next, the configuration of the starter 4 will be described.

The starter 4 includes a motor 13, an output shaft 14, an overrunning clutch 15, a pinion 16, an electromagnetic switch device 17 for a starter, a shift lever 18, and a front bracket 19.

The motor 13 generates rotational force by power from the battery 5.

The output shaft 14 transmits the rotational force of the motor to the overrunning clutch 15.

The overrunning clutch 15 is provided on the output shaft 14 so as to be movable in the axial direction, and transmits, to the pinion 16, the rotational force of the motor 13 transmitted from the output shaft 14.

The pinion 16 transmits, to the ring gear 3 of the engine 2, the rotational force of the motor 13 transmitted from the overrunning clutch 15.

The electromagnetic switch device 17 for a starter moves the overrunning clutch 15 in the axial direction on the output shaft 14 via the shift lever 18, and opens or closes an electric circuit between the battery 5 and the motor 13 in response to the start signal from the control device 7.

The shift lever 18 transmits propulsive force of the electromagnetic switch device 17 for a starter to the overrunning clutch 15, to move the overrunning clutch 15 on the output shaft 14.

The front bracket 19 fixes the starter 4 to the engine 2, and forms an electric circuit of the motor 13 and the electromagnetic switch device 17 for a starter.

Figure 3:
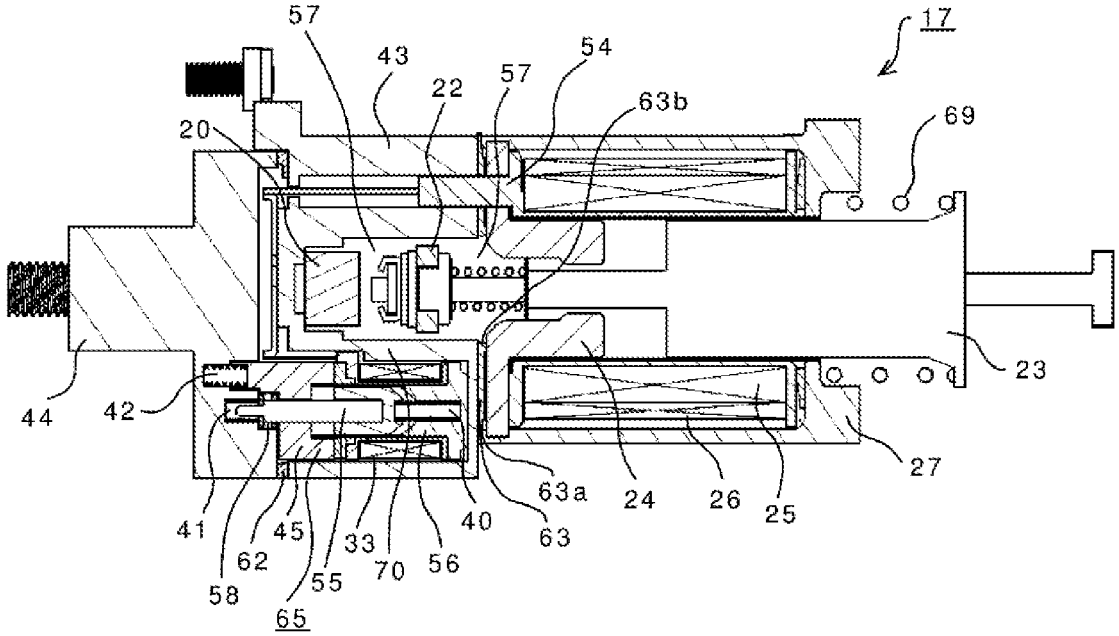
FIG. 3 is a cross-sectional view of the electromagnetic switch device for a starter in FIG. 1.

Next, the configuration of the electromagnetic switch device 17 for a starter will be described (see FIGS. 3 and 4).

The electromagnetic switch device 17 for a starter of Embodiment 1 includes: a pair of main fixed contacts 20 which form a motor electric circuit for supplying power to the motor 13 and which are located at positions electrically and mechanically away from each other; the battery terminal 11 having an end at which one main fixed contact 20*a* of the pair of main fixed contacts 20 is formed, and having another end to which a wire electrically connected to the battery positive terminal 5*a* of the battery 5 is fixed; a motor terminal 21 having an end at which the other main fixed contact 20*b* of the pair of main fixed contacts 20 is formed, and having another end to which a wire connected to the motor 13 is fixed; a main movable contact 22 which electrically connects the pair of main fixed contacts 20 to each other to form the motor electric circuit; a main movable core 23 which is made of a magnetic material and which moves the main movable contact 22 toward the pair of main fixed contacts 20; a main fixed core 24 which is made of a magnetic material and which generates attraction force between the main movable core 23 and the main fixed core 24; an attraction coil 25 which generates a magnetic field for attracting the main movable core 23 to the main fixed core 24; a holding coil 26 which generates a magnetic field for holding the main movable core 23 at the movement end after the attraction; and a main yoke 27 which is made of a magnetic material and which serves as a magnetic circuit for the magnetic fields generated by the attraction coil 25 and the holding coil 26.

The electromagnetic switch device 17 for a starter also includes: a pair of sub fixed contacts 28 which form an electric circuit for supplying power to the attraction coil 25 and the holding coil 26 and which are located at positions electrically and mechanically away from each other; a sub movable contact 29 which forms the electric circuit for supplying power to the attraction coil 25 and the holding coil 26 by electrically connecting the pair of sub fixed contacts 28 to each other; a sub movable core 31 which is made of magnetic material and which generates propulsive force for moving the sub movable contact 29 toward the pair of sub fixed contacts 28; a sub coil 33 which generates a magnetic field as a base for the propulsive force of the sub movable core 31; a sub yoke 30 which serves as a magnetic circuit for the magnetic field of the sub coil 33; and a pair of sub fixed cores 32 which are located at both ends of the sub yoke 30 and which serve as a magnetic circuit.

The electromagnetic switch device 17 for a starter further includes a terminal block 43 in which a main contact chamber 57 and the sub coil 33 are located adjacent to each other in the radial direction with a partition wall 70 provided therebetween so as to separate the sub coil 33 and the main contact chamber 57 from each other.

Furthermore, in the electromagnetic switch device 17 for a starter, electric circuits, such as the pair of sub fixed contacts 28, a battery connector 34 which forms the one sub fixed contact 28*a* of the sub fixed contacts 28, an SW connector 35 which forms the other sub fixed contact 28*b*, an S positive connector 37 for supplying power to the sub coil 33, an S negative connector, a motor connector 36 which connects the attraction coil 25 to the motor terminal 21, and a ground connector 39 which connects the holding coil 26 to the battery negative wire 9, are located on an end surface 43*a* of the terminal block 43 at the side opposite to the attraction coil 25 in the axial direction, that is, on the same plane.

In addition, methods for electrical connection of wires for these electric circuits are different depending on the type, either ground floating type or body ground type.

The battery terminal 11 and the motor terminal 21 each of which has a threaded portion formed at one end thereof and a head portion formed at another end thereof are screwed via a pair of washers 48 by means of a pair of nuts 49 such that the battery connector 34, the SW connector 35, the motor connector 36, the S positive connector 37, the S negative connector 38, and the ground connector 39, which form these electric circuits, are held between the terminal block 43 and a cover 44 which is made of a conductor and which has a B bush 46 and an M bush 47 formed by insert-molding therein.

The head portions of the battery terminal 11 and the motor terminal 21 form surfaces to be fitted to the terminal block 43 and inhibit the battery terminal 11 and the motor terminal 21 from rotating relative to the terminal block 43.

In addition, a nut 49*a* which is in contact with the battery terminal 11, a washer 48*a* which is in contact with the nut 49*a*, the B bush 46 which is in contact with the washer 48*a*, and the battery connector 34 which is in contact with the B bush 46 form an electric circuit, and a nut 49*b* which is in contact with the motor terminal 21, a washer 48*b* which is in contact with the nut 49*b*, the M bush 47 which is in contact with the washer 48*b*, and the motor connector 36 which is in contact with the M bush 47 form an electric circuit.

The main movable contact 22 is a plate-shaped conductive material having, at the center thereof, a through hole through which the main movable core 23 penetrates. One end surface in the plate-thickness direction of the main movable contact 22 forms a surface to be in contact with the pair of main fixed contacts 20 and a surface to be in contact with an insulating plate 50, the other end surface thereof forms a surface to be in contact with an insulating member 51, and the inner circumference of the through hole forms a surface to be in contact with the insulating member 51.

The main movable contact 22 is held in an insulated manner by the insulating member 51 and the insulating plate 50 with respect to the main movable core 23.

The main movable core 23 is a solid round stepped rod made of a magnetic material, and forms a magnetic circuit.

The insulating plate 50, the insulating member 51, the main movable contact 22, and a main contact spring 52 are fixed to a small-diameter portion 23*a* of the main movable core 23 by means of a fastening ring 53.

A surface, of the main movable core 23, opposed to the main fixed core 24 forms a surface to be in contact with the main fixed core 24.

A flange portion 23*b* of the main movable core 23 is engaged with the shift lever 18.

The main movable core 23 may be formed in a hollow shape such that a spring is provided therein, thereby to be applied to an electromagnetic push type starter.

The main fixed core 24 is a cylinder made of a magnetic material, has a flange portion 24*a* at one end thereof and a stepped through hole at the center thereof, and forms a magnetic circuit.

The outer circumference of the flange portion 24*a* is fitted to the main yoke 27, and one end surface of the flange portion 24*a* is swaged and fixed circumferentially after the main yoke 27 is fitted.

The other end surface of the flange portion 24*a* is in contact with the main yoke 27 and a main bobbin 54 having the attraction coil 25 and the holding coil 26 wound thereon.

The flange portion 24*a* has many through holes formed therein, and lead-out portions of the attraction coil 25 and the holding coil 26 on the main bobbin 54 are fitted to the respective through holes.

The small-diameter portion 23*a* of the main movable core 23 penetrates through the center of the flange portion 24*a*.

The attraction coil 25 is an enamel-coated conductor wound on the main bobbin 54, and generates a magnetic field for attracting the main movable core 23 toward the main fixed core 24.

One end of the attraction coil 25 is electrically connected to the motor connector 36.

The other end thereof is electrically connected to the SW connector 35.

Regarding the method for the connection, a coil lead-out wire is connected by means of welding, pressure bonding, or the like.

The holding coil 26 is an enamel-coated conductor wound on the main bobbin 54, and generates a magnetic field for attracting and holding the main movable core 23 toward the main fixed core 24.

One end of the holding coil 26 is electrically connected to the SW connector 35.

The other end thereof is electrically connected to the ground connector 39.

Alternatively, the other end thereof may be electrically connected to the main fixed core 24, whereby a body ground type connection may be formed.

The main yoke 27 is made of a magnetic material and serves as a magnetic circuit for the magnetic fields generated by the attraction coil 25 and the holding coil 26.

The main yoke 27 has a bottomed cylindrical shape, and has, at the bottom thereof, a through hole through which the main movable core 23 penetrates, and a threaded hole for fixation to the front bracket 19. The attraction coil 25 and the holding coil 26 are housed inside the cylindrical body of the main yoke 27.

After the main fixed core 24 is fitted to an end surface at the side opposite to the bottom of the cylindrical body, the entire circumference of the end portion of the cylindrical body is swaged so as to be folded radially inward, whereby the main fixed core 24 is fixed.

Figure 5:
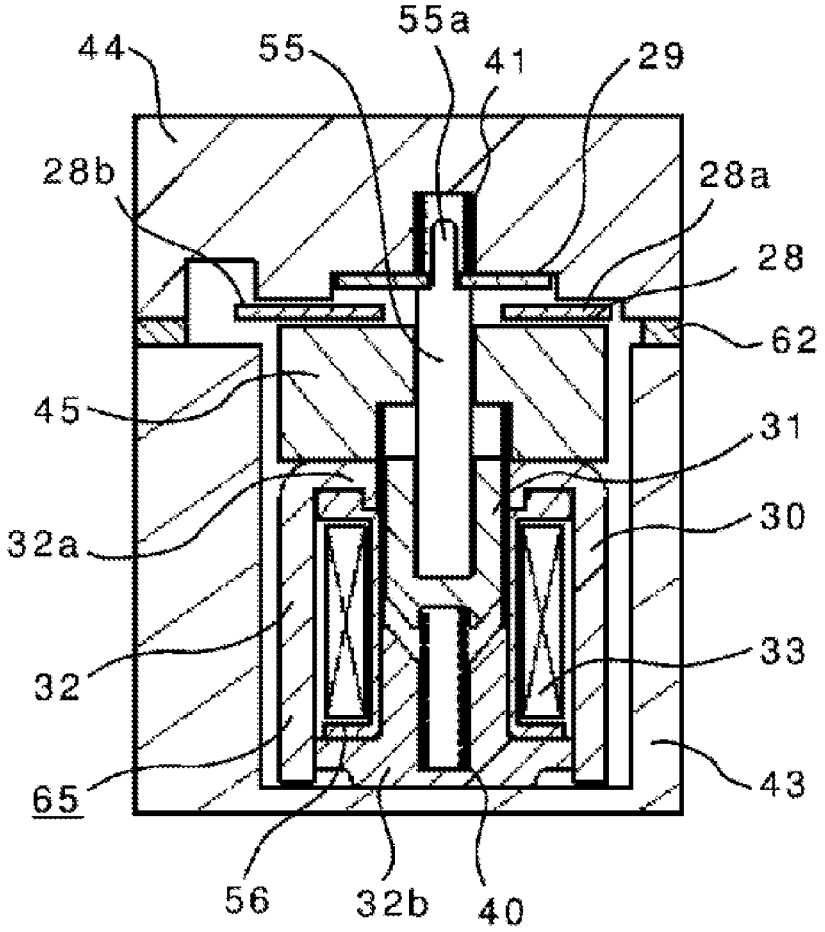
FIG. 5 is a cross-sectional view of an auxiliary relay in the electromagnetic switch device for a starter according to Embodiment 1 of the present invention.
Figure 6:
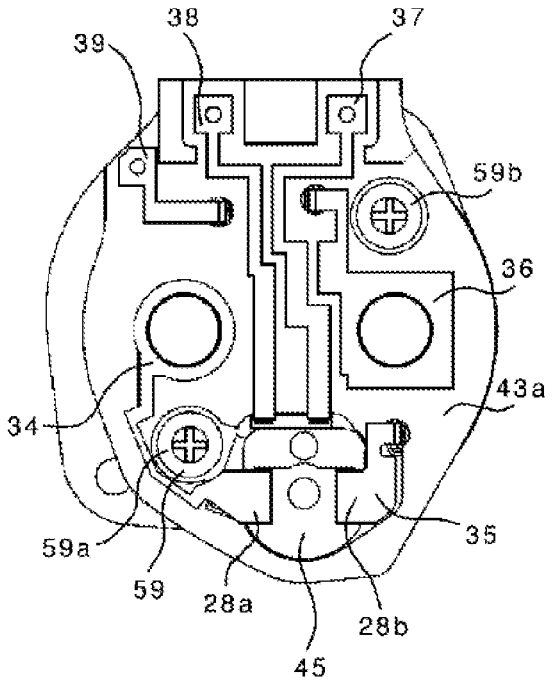
FIG. 6 is a side view of a terminal block of the electromagnetic switch device for a starter according to Embodiment 1 of the present invention as seen from the left side in FIG. 1 immediately after the terminal block is screwed to a main fixed core by means of bolts.

Next, the configuration of an auxiliary relay 65 will be described (see FIGS. 5 and 6).

The one sub fixed contact 28*a* of the pair of sub fixed contacts 28 is formed by a plate material made of the same conductor as the battery connector 34, and the other sub fixed contact 28*b* is formed by a plate material made of the same conductor as the SW connector 35, to form an electric circuit for the attraction coil 25 and the holding coil 26.

A surface, of the pair of sub fixed contacts 28, that is one end surface in the plate-thickness direction and that is opposed to the sub movable contact 29 is a surface to be in contact with the sub movable contact 29.

The sub movable contact 29 is a plate material made of a conductor, and has, at the center thereof, a through hole through which a rod 55 penetrates and forms an electric circuit for the attraction coil 25 and the holding coil 26.

One end surface in the plate-thickness direction of the sub movable contact 29 is a surface to be in contact with the pair of sub fixed contacts 28. The other end surface thereof is a surface to be in contact with the cover 44. The rod 55 penetrates through the center of the sub movable contact 29, and a sub contact spring 41 having, at both ends thereof, close winding portions narrowed to the same degree as a small-diameter portion 55*a* of the rod 55 is inserted onto the small-diameter portion 55*a* of the penetrating rod 55, whereby the penetrating rod 55 and the sub contact spring 41 can be integrated with each other to form a contact rod ASSY 60 (see FIG. 7).

The pair of sub fixed cores 32 are magnetic materials serving as a magnetic circuit together with the sub yoke 30.

One sub fixed core 32*a* of the pair of sub fixed cores 32 is formed of the same member as the sub yoke 30.

The sub fixed core 32*a* has a flange portion and a through hole penetrating therethrough, and a flat plate portion obtained by bending the flange portion at a right angle is the sub yoke 30. One end surface of the flange portion forms a surface to be in contact with a sub bobbin 56, and the other end surface thereof forms a surface to be in contact with a holder 45.

The other sub fixed core 32*b* has a flanged and bottomed cylindrical shape, an opening surface thereof forms a tapered surface, and a sub return spring 40 is housed inside the cylindrical body thereof.

An end surface thereof at the side opposite to the opening surface forms a surface to be in contact with the terminal block 43, and a flange portion thereof forms a portion to be fitted to the sub yoke 30.

The sub movable core 31 serves as a magnetic circuit for the magnetic field generated by the sub coil 33, has a tapered surface at one end of a cylinder made of a magnetic material, and forms hollow portions at both ends of the cylinder.

The sub movable core 31 is located inside the cylinder of the sub bobbin 56, the tapered surface at the one end thereof is opposed to the tapered surface of the sub fixed core 32*b*, and the sub return spring 40 is housed in the hollow portion at the tapered surface side.

The rod 55 is housed inside the cylindrical interior of the sub movable core 31 at the other end, and the end surface thereof is opposed to the holder 45.

The sub coil 33 is an enamel-coated conductor wound on the sub bobbin 56, and generates a magnetic field for moving and holding the sub movable core 31 from the sub fixed core 32*a* toward the sub fixed core 32*b*.

One end of the sub coil 33 is connected to the S positive connector 37 to be electrically connected to the S circuit wire 10, and the other end thereof is connected to the S negative connector 38 to be electrically connected to the battery wire 9.

Figure 7:
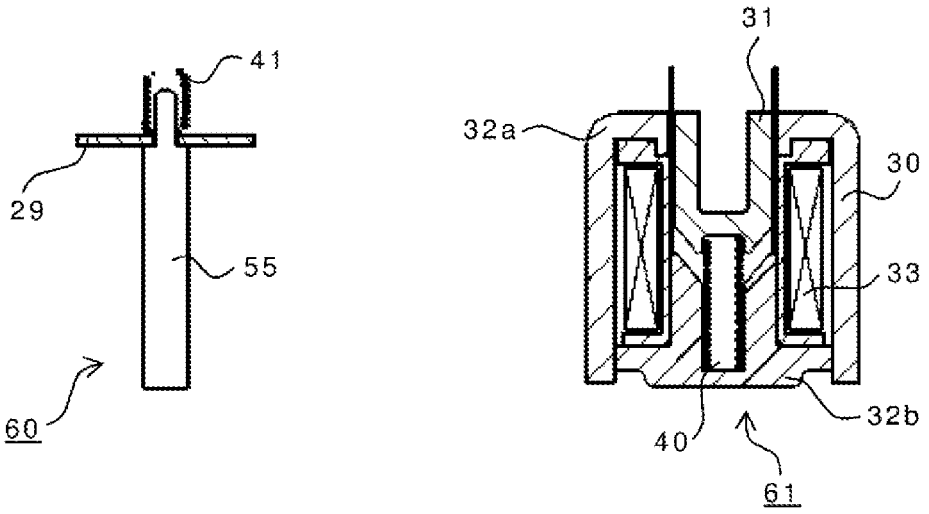
FIG. 7 is a cross-sectional view of a sub ASSY forming a relay portion of the electromagnetic switch device for a starter according to Embodiment 1 of the present invention.
Figure 8:
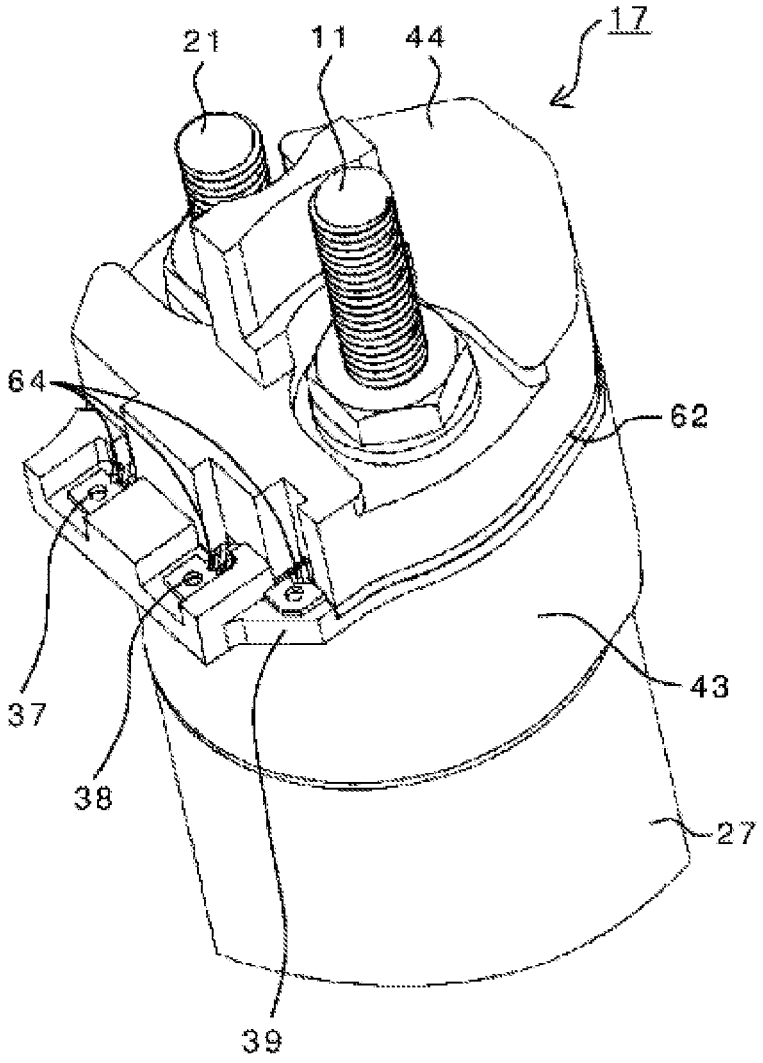
FIG. 8 is a side view of the electromagnetic switch device for a starter according to Embodiment 1 of the present invention as seen from the left side in FIG. 1.
Figure 9:
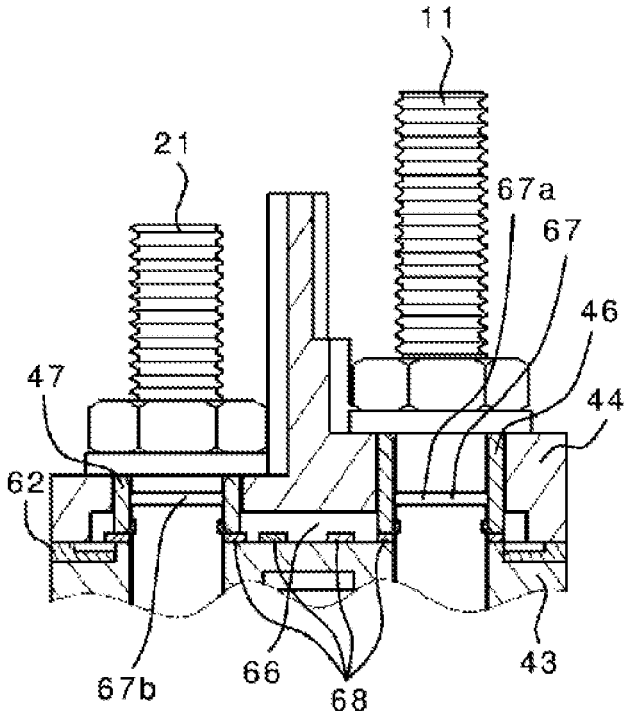
FIG. 9 is a cross-sectional view of an electric circuit of the electromagnetic switch device for a starter according to Embodiment 1 of the present invention and an area surrounding the electric circuit.
Figure 10A:
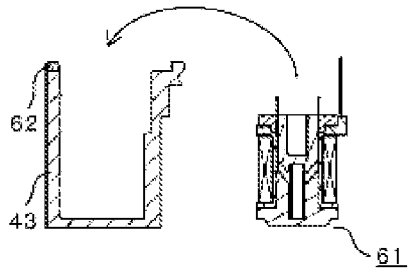
FIG. 10A to FIG. 10F illustrate a procedure for assembling the auxiliary relay in the electromagnetic switch device for a starter according to Embodiment 1 of the present invention.
Figure 10D:
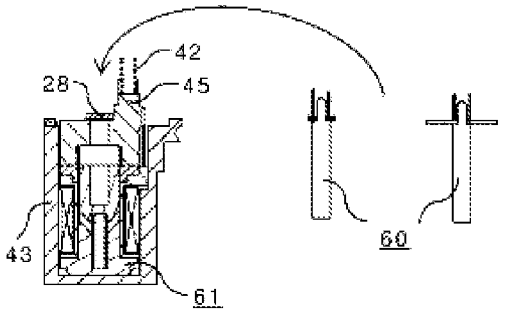
Figure 10B:
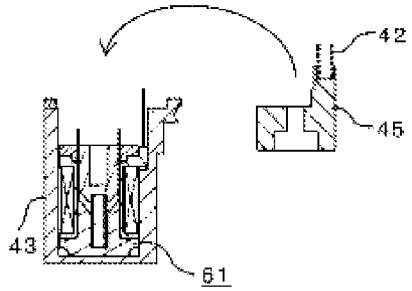
Figure 10E:
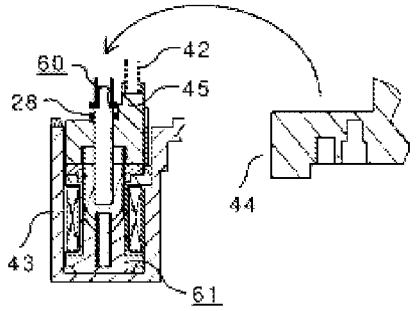
Figure 10C:
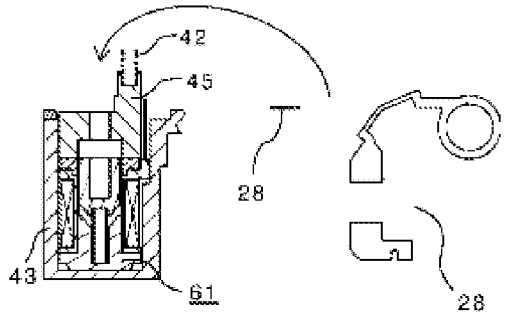
Figure 10F:
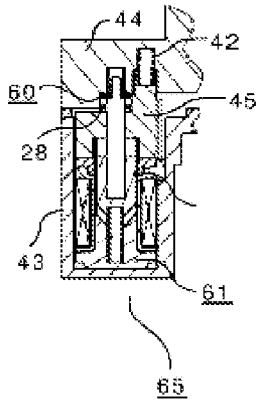

The sub movable core 31, the sub coil 33, and the sub return spring 40 are integrated with each other by fitting the pair of sub fixed cores 32 via the sub yoke 30, whereby a relay ASSY 61 can be formed (see FIG. 7).

The holder 45 is an insulating material, and has a through hole and a bottomed cylindrical portion which is located at one end in the axial direction of the through hole and which has a central axis different from that of the through hole. A cover spring 42 which is an elastic member is housed in the bottomed cylindrical portion.

The other end in the axial direction of the through hole forms a surface to be in contact with the sub fixed core 32*a*.

In addition, the rod 55 penetrates through the through hole.

Next, a procedure for assembling the auxiliary relay 65 of the electromagnetic switch device 17 for a starter will be described with reference to FIG. 10A-10F.

FIG. 10A

After an upper packing 62 is supplied to the terminal block 43, the relay ASSY 61 assembled in a sub ASSY assembly line is supplied to the terminal block 43.

FIG. 10B

Next, the holder 45 and the cover spring 42 are supplied onto the relay ASSY 61.

FIG. 10C

Next, the pair of the sub fixed contacts 28 are supplied onto the holder 45.

The sub fixed core 32 is located on the end surface 43*a* of the terminal block 43.

Since the end surface of the holder 45 opposed to the pair of sub fixed contacts 28 is located below the end surface 43*a* of the terminal block 43, a state where the sub fixed contacts 28 appear to float is not brought about.

FIG. 10D

Next, the contact rod ASSY 60 assembled in the sub ASSY assembly line is supplied through the through hole of the holder 45 onto the sub movable core 31 of the relay ASSY 61.

FIG. 10E

Finally, the cover 44 is supplied onto the upper packing 62, and the battery terminal 11 and the motor terminal 21 are screwed by means of the pair of nuts 49, whereby the terminal block 43 and the cover 44 are fixed to each other.

FIG. 10F

The assembled auxiliary relay 65 of the electromagnetic switch device 17 for a starter is shown.

In the electromagnetic switch device 17 for a starter assembled and configured as described above, not only a load by the cover spring 42 but also a load by the sub return spring 40 contributes to fixation of the relay ASSY 61, and thus vibration resistance can be improved.

In addition, assemblability is improved by making the components forming the auxiliary relay 65, into a sub ASSY, and a starter having low cost can be provided by reducing assembling deficiencies.

Furthermore, an electric circuit 68 is housed in the terminal block 43, and thus waterproofness and corrosion resistance can be improved.

In the electromagnetic switch device for a starter configured as described above, the main contact chamber 57 is a space, in the terminal block 43, in which the pair of main fixed contacts 20 are located and the main movable contact 22 is movable.

A sub contact chamber 58 is a space in which the pair of sub fixed contacts 28 and the sub movable contact 29 are located and which is formed by the cover 44 and the holder 45.

The terminal block 43 is made of an insulating material and has a cylindrical shape a part of which protrudes in the radial direction. At one end of the terminal block 43, the battery connector 34, the SW connector 35, the motor connector 36, the S positive connector 37, the S negative connector 38, the ground connector 39, and the S terminal 12 are located, and the terminal block 43 has an opening of a space in which the relay ASSY 61 is located. At the other end of the terminal block 43, the terminal block 43 has an opening of the main contact chamber 57. The terminal block 43 has, in the main contact chamber 57, a surface to be fitted to the battery terminal 11 and a surface to be fitted to the motor terminal 21.

The space in which the sub coil 33 is located and the main contact chamber 57 are located adjacent to each other in the radial direction and are separated from each other by the partition wall.

A bolt 59*a* located at the sub coil 33 side and a bolt 59*b* located so as to be diagonally opposite to the bolt 59*a* are used for fixing the terminal block 43 to the main fixed core 24. Head portions of the respective bolts are brought into contact with the end surface of the terminal block 43, and threaded portions of the respective bolts are screwed into threaded holes of the main fixed core 24.

Figure 4:
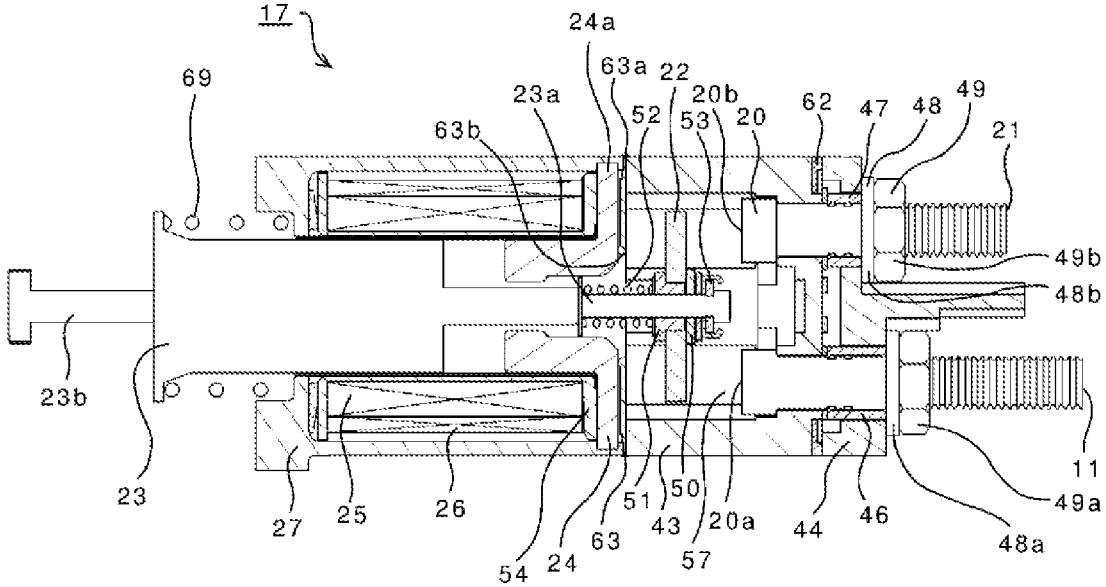
FIG. 4 is another cross-sectional view of the electromagnetic switch device for a starter according to Embodiment 1 of the present invention.
Figure 11A:
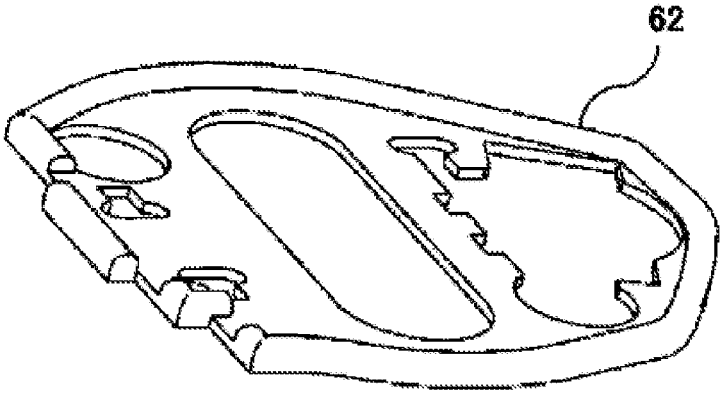
FIG. 11A and FIG. 11B show perspective views of an upper packing and a lower packing in the electromagnetic switch device for a starter according to Embodiment 1 of the present invention.

The upper packing 62 is an elastic body such as chloroprene rubber, has a shape as shown in FIG. 11A, and is pressingly held between the end surface of the terminal block 43 and the end surface of the cover 44, thereby preventing entry of water from the outside (FIG. 4).

Figure 11B:
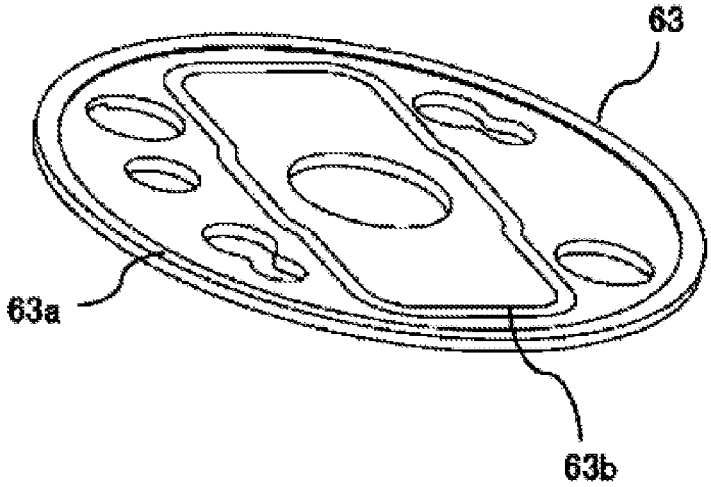

A lower packing 63 is an elastic body such as chloroprene rubber, has a shape as shown in FIG. 11B, and has an outer peripheral end 63*a* which is pressingly held between the surface of the main yoke 27 swaged so as to be folded to the main fixed core 24 and the end surface of the terminal block 43, thereby preventing entry of water from the outside (FIG. 4).

In addition, the lower packing 63 has an inner peripheral end 63*b* which is pressingly held between the open end portion of the main contact chamber 57 and the main fixed core 24, thereby preventing entry of water into the main contact chamber 57.

The seal material 64 is a liquid seal material that has an insulating function, a rustproof function, a waterproof function and that can be cured by temperature, moisture, ultraviolet rays, or the like after being applied. The seal material 64 is applied to gaps formed by the S positive connector 37, the S negative connector 38, the ground connector 39, the terminal block 43, the upper packing 62, and the cover 44.

The cover spring 42 has a function to fix the auxiliary relay 65, which is located in a space between the terminal block 43 and the cover 44, such that the auxiliary relay 65 resists external force such as vibration.

During operation of the internal combustion engine, the electromagnetic switch device for a starter is in a non-operating state, and the sub return spring biases the sub fixed core 32*a* toward the terminal block, so that the sub return spring 40 acts to assist in the fixing function of the cover spring.

An O ring 67*a* and an O ring 67*b* each have a structure to ensure waterproofness for protecting the electric circuit 68 which includes the pair of sub fixed contacts 28, the sub movable contact 29, the sub coil 33, the battery connector 34, the SW connector 35, the motor connector 36, the S positive connector 37, the S negative connector 38, and the ground connector 39.

The outer circumference of the battery terminal 11 and the inner circumference of the O ring 67*a*, and the inner circumference of the B bush 46 and the outer circumference of the O ring 67*a* form seal surfaces to cut off a water entry path.

Similarly, the outer circumference of the motor terminal 21 and the inner circumference of the O ring 67*b*, and the inner circumference of the M bush 47 and the outer circumference of the O ring 67*b* form seal surfaces to cut off a water entry path.

Next, operation of the electromagnetic switch device 17 for a starter will be described.

When the key switch 6 is turned on and a voltage is applied from the control device 7 via the S circuit wire 10 to the S terminal 12, a current flows through the sub coil 33.

The current flowing through the sub coil 33 is about several hundred mA to several A, and is ON/OFF-controlled by a contact relay or a semiconductor relay in the control device 7.

When the current flows through the sub coil 33, a magnetic field is generated and a magnetic flux flows through a magnetic circuit which includes the sub yoke 30, the sub fixed core 32*a*, the sub fixed core 32*b*, the sub movable core 31, and gaps among these components.

An inter-core gap is present between the sub fixed core 32*b* and the sub movable core 31, and the magnetic flux flowing through the magnetic circuit generates attraction force that moves the sub movable core 31 toward the sub fixed core 32*b* such that the inter-core gap is decreased.

At one end, of the sub movable core 31, opposite to its surface opposed to the sub fixed core 32*b*, the rod 55, the sub movable contact 29, and the sub contact spring 41 are located in this order. Thus, when the sub movable core 31 moves toward the sub fixed core 32*b*, the sub movable contact 29 moves toward the pair of sub fixed contacts 28 due to a load by the sub contact spring 41.

When the inter-contact gap between the sub movable contact 29 and the pair of sub fixed contacts 28 disappears, the electric circuit for the attraction coil 25 and the holding coil 26 is closed, so that a current flows through the attraction coil 25 and the holding coil 26.

Even after the current flows through the attraction coil 25 and the holding coil 26, the current continues to flow through the sub coil 33. Thus, the sub movable core 31 continues to move until the sub movable core 31 comes into contact with the sub fixed core 32*b*, and after the sub movable core 31 comes into contact with the sub fixed core 32*b*, the sub movable core 31 is held in this state.

When the current flows through the attraction coil 25 and the holding coil 26, a magnetic field is generated and a magnetic flux flows through a magnetic circuit which includes the main yoke 27, the main fixed core 24, the main movable core 23, and gaps present among these components.

An inter-core gap is present between the main fixed core 24 and the main movable core 23, and the magnetic flux flowing through the magnetic circuit generates attraction force that moves the main movable core 23 toward the main fixed core 24 such that the inter-core gap is decreased.

Since the main movable contact 22 is located at one end of the main movable core 23, when the main movable core 23 moves toward the pair of main fixed contacts 20, and the main movable contact 22 comes into contact with the pair of main fixed contacts 20, a motor circuit is closed and a voltage is applied to the motor terminal 21, so that the motor 13 starts to rotate.

One end of the attraction coil 25 is electrically connected to one end of the pair of sub fixed contacts 28, and the other end of the attraction coil 25 is electrically connected to the motor terminal 21. Thus, at the same time as the pair of main fixed contacts 20 and the main movable contact 22 come into contact with each other and the voltage is applied to the motor terminal 21, a potential difference between both ends of the attraction coil 25 almost disappears. Accordingly, after a transient phenomenon has finished, almost no current flows through the attraction coil 25.

The main movable core 23 continues to move until the main movable core 23 comes into contact with the main fixed core 24, due to inertial force of the main movable core 23 itself, a transient current of the attraction coil 25, and a current of the holding coil 26.

After the main movable core 23 and the main fixed core 24 come into contact with each other, the inter-core gap disappears, and therefore the amount of magnetic flux needed for holding is significantly reduced, and the main movable core 23 and the main fixed core 24 are held in the contact state by the holding force of the holding coil 26.

Through a process in which the main movable core 23 is attracted to the main fixed core 24, the pinion 16 is moved toward the ring gear 3 by the shift lever 18 connected with the main movable core 23, and the pinion 16 and the ring gear 3 are engaged with each other by their tooth flanks, whereby torque generated by the motor 13 is transmitted from the pinion 16 to the ring gear 3.

When the motor 13 rotates, the engine 2 starts to rotate via the pinion 16 and the ring gear 3.

When the engine 2 reaches a rotation speed that allows self-rotation of the engine 2, the engine 2 starts self-rotation.

This is the description of operation when the starter 4 starts to rotate the engine 2.

Hereinafter, stop operation of the starter 4 after the engine 2 starts self-rotation will be described. It is noted that the starter 4 performs the same stop operation also when an operator of the key switch 6 turns off the key switch 6 before the engine 2 starts self-rotation, or when the control device 7 itself determines that starting is unnecessary or impossible.

After the engine 2 starts self-rotation, operation of the starter 4 becomes necessary, and therefore, the operator of the key switch 6 turns off the key switch 6 or the control device 7 itself performs determination to stop voltage application to the S terminal 12.

When the voltage application to the S terminal 12 is stopped, the current does not flow through the sub coil 32 any longer. As a result, the holding force between the sub movable core 31 and the sub fixed core 32*b* disappears, and by the force of the sub return spring 40, the sub movable core 31 moves away from the sub fixed core 32*b* and returns to the original position.

In this process, the sub movable contact 29 receives force in the direction away from the pair of sub fixed contacts 28 via the rod 55 and thus moves away from the pair of sub fixed contacts 28, so that the electric circuit for the attraction coil 25 and the holding coil 26 is opened and the current does not flow through the attraction coil 25 and the holding coil 26 any longer.

When the current does not flow through the attraction coil 25 and the holding coil 26 any longer, the force for holding the main movable core 23 to the main fixed core 24 disappears, and the main movable core 23 returns to the original position by the force of a main return spring 69. In this process, the main movable contact 22 is separated from the pair of main fixed contacts 20 and thus the motor circuit is opened, so that the current does not flow through the motor 13 any longer and rotation of the motor 13 is stopped.

In addition, in this process, the pinion 16 is returned to the original position by the shift lever 18 connected with the main movable core 23 and is disengaged from the ring gear 3.

This is the description of the stop operation of the starter 4.

As described above, the electromagnetic switch device for a starter according to Embodiment 1 of the present invention includes: an electromagnetic switch which includes a pair of main fixed contacts, a main movable contact, and a main coil (one of or both an attraction coil and a holding coil), which opens and closes an electric circuit for a motor via the pair of main fixed contacts, and which engages a pinion with a ring gear via a shift lever when the main coil is energized; an auxiliary relay which includes a pair of sub fixed contacts, a sub movable contact, and a sub coil, the pair of sub fixed contacts being connected to the main coil of the electromagnetic switch, the auxiliary relay energizing the main coil of the electromagnetic switch via the pair of sub fixed contacts in response to a start signal; a terminal block in which a main contact chamber that is open at the main coil side in an axial direction and in which the pair of main fixed contacts and the main movable contact are located, and the auxiliary relay that is open at a side opposite to the main coil side in the axial direction, are located; a cover provided at an opening side of the terminal block at which the auxiliary relay is located, the cover having through holes through which the main fixed contacts penetrate in a state where the auxiliary relay is sealed; and an elastic member (cover spring 42) which is located between the auxiliary relay and the cover and which fixes the auxiliary relay in the axial direction together with the terminal block and the cover, and the elastic member which fixes the auxiliary relay in the axial direction is located between the auxiliary relay and the cover. Thus, the effect that vibration resistance is improved without deterioration of the assemblability of the electromagnetic switch device for a starter is obtained.

In addition, the electromagnetic switch device for a starter includes a packing on an end surface of the terminal block at the opening side at which the auxiliary relay is located, and has a structure in which an internal wire and the auxiliary relay located in the terminal block are held among the terminal block, the packing, and the cover. Thus, in addition to the improvement of the vibration resistance, entry of water from the outside can be prevented by pressingly holding the packing between the end surface of the terminal block and the end surface of the cover.

In addition, the electromagnetic switch device for a starter has a structure in which a second packing is pressingly held between the end surface of the terminal block and a surface of the main yoke swaged to a main fixed core. Thus, entry of water from the outside can be further prevented.

The electromagnetic switch device for a starter includes: a connector transmitting the start signal to the auxiliary relay; and a liquid seal material adhered in a gap at a location where the connector is exposed to the outside in a state where the connector penetrates through the packing. Thus, an insulating function, a rustproof function, a waterproof function can be ensured.

The present invention is not limited to the embodiments, various design modifications can be made, and within the scope of the present invention, the embodiments may be freely combined with each other, or each embodiment may be modified or simplified as appropriate.

DESCRIPTION OF THE REFERENCE CHARACTERS

1 internal combustion engine device
2 engine
3 ring gear
4 starter
5 battery
5*a* battery positive terminal
5*b* battery negative terminal
6 key switch
7 control device
8 battery positive wire
9 battery negative wire
10 S circuit wire
11 battery terminal
12 S terminal
13 motor
14 output shaft
15 overrunning clutch
16 pinion
17 electromagnetic switch device for a starter
18 shift lever
19 front bracket
20 a pair of main fixed contacts
20*a*, 20*b* main fixed contact
21 motor terminal
22 main movable contact
23 main movable core
23*a* small-diameter portion
23*b* flange portion
24 main fixed core
25 attraction coil
26 holding coil
27 main yoke
28 a pair of sub fixed contacts
28*a*, 28*b* sub fixed contact
29 sub movable contact
30 sub yoke
31 sub movable core
32 a pair of sub fixed cores
32*a*, 32*b* sub fixed core
33 sub coil
34 battery connector
35 SW connector
36 motor connector
37 S positive connector
38 S negative connector
39 ground connector
40 sub return spring
41 sub contact spring
42 cover spring
43 terminal block
44 cover
45 holder
46 B bush
47 M bush
48 a pair of washers
48*a*, 48*b* washer
49 a pair of nuts
49*a*, 49*b* nut
50 insulating plate
51 insulating member
52 main contact spring
53 fastening ring
54 main bobbin
55 rod
56 sub bobbin
57 main contact chamber
58 sub contact chamber
59 a pair of bolts
59*a*, 59*b* bolt
60 contact rod ASSY
61 relay ASSY
62 upper packing
63 lower packing
63*a* outer peripheral end
63*b* inner peripheral end
64 seal material
65 auxiliary relay
66 space
67 a pair of O rings
67*a*, 67*b* O ring
68 electric circuit
69 main return spring
70 partition wall

The invention claimed is:

1. An electromagnetic switch device for a starter, comprising:

an electromagnetic switch which includes a pair of main fixed contacts, a main movable contact, and a main coil, which opens and closes an electric circuit for a motor via the pair of main fixed contacts, and which engages a pinion with a ring gear via a shift lever when the main coil is energized;

an auxiliary relay which includes a pair of sub fixed contacts, a sub movable contact, and a sub coil, the pair of sub fixed contacts being connected to the main coil of the electromagnetic switch, the auxiliary relay energizing the main coil of the electromagnetic switch via the pair of sub fixed contacts in response to a start signal;

a terminal block in which a main contact chamber that is open at the main coil side in an axial direction and in which the pair of main fixed contacts and the main movable contact are located, and the auxiliary relay that is open at a side opposite to the main coil side in the axial direction, are located;

a cover provided at an opening side of the terminal block at which the auxiliary relay is located, the cover having through holes through which the main fixed contacts penetrate in a state where the auxiliary relay is sealed; and an elastic member which is located between the auxiliary relay and the cover and which fixes the auxiliary relay in the axial direction together with the terminal block and the cover.

2. The electromagnetic switch device for a starter according to claim 1, wherein the auxiliary relay includes:

a sub movable core moving the sub movable contact toward the pair of sub fixed contacts;

a sub return spring biasing the sub movable core in a direction in which the sub movable core is maintained in a stationary state;

a sub yoke serving as a magnetic circuit for a magnetic field of the sub coil; and a pair of sub fixed cores located at both ends of the sub yoke and serving as a magnetic circuit, and the sub yoke and the pair of sub fixed cores are integrally fixed in a state where one end of the sub return spring is in contact with one of the pair of sub fixed cores.

3. The electromagnetic switch device for a starter according to claim 2, wherein the main coil includes one of or both an attraction coil and a holding coil.

4. The electromagnetic switch device for a starter according to claim 3, wherein the auxiliary relay includes a holder including: a through hole through which a rod connected with the sub movable contact penetrates; and a bottomed cylindrical portion which is located at the cover side and in which a cover spring that is the elastic member is housed.

5. The electromagnetic switch device for a starter according to claim 4, further comprising a packing on an end surface of the terminal block at the opening side at which the auxiliary relay is located, wherein the electromagnetic switch device for a starter has a structure in which an internal wire and the auxiliary relay located in the terminal block are held among the terminal block, the packing, and the cover.

6. The electromagnetic switch device for a starter according to claim 3, further comprising a packing on an end surface of the terminal block at the opening side at which the auxiliary relay is located, wherein the electromagnetic switch device for a starter has a structure in which an internal wire and the auxiliary relay located in the terminal block are held among the terminal block, the packing, and the cover.

7. The electromagnetic switch device for a starter according to claim 6, further comprising:

a connector transmitting the start signal to the auxiliary relay; and a liquid seal material adhered in a gap at a location where the connector is exposed to the outside in a state where the connector penetrates through the packing.

8. The electromagnetic switch device for a starter according to claim 2, wherein the auxiliary relay includes a holder including: a through hole through which a rod connected with the sub movable contact penetrates; and a bottomed cylindrical portion which is located at the cover side and in which a cover spring that is the elastic member is housed.

9. The electromagnetic switch device for a starter according to claim 8, further comprising a packing on an end surface of the terminal block at the opening side at which the auxiliary relay is located, wherein the electromagnetic switch device for a starter has a structure in which an internal wire and the auxiliary relay located in the terminal block are held among the terminal block, the packing, and the cover.

10. The electromagnetic switch device for a starter according to claim 9, further comprising:

a connector transmitting the start signal to the auxiliary relay; and a liquid seal material adhered in a gap at a location where the connector is exposed to the outside in a state where the connector penetrates through the packing.

11. The electromagnetic switch device for a starter according to claim 2, further comprising a packing on an end surface of the terminal block at the opening side at which the auxiliary relay is located, wherein the electromagnetic switch device for a starter has a structure in which an internal wire and the auxiliary relay located in the terminal block are held among the terminal block, the packing, and the cover.

12. The electromagnetic switch device for a starter according to claim 11, further comprising:

a connector transmitting the start signal to the auxiliary relay; and a liquid seal material adhered in a gap at a location where the connector is exposed to the outside in a state where the connector penetrates through the packing.

13. The electromagnetic switch device for a starter according to claim 1, wherein the main coil includes one of or both an attraction coil and a holding coil.

14. The electromagnetic switch device for a starter according to claim 13, wherein the auxiliary relay includes a holder including: a through hole through which a rod connected with the sub movable contact penetrates; and a bottomed cylindrical portion which is located at the cover side and in which a cover spring that is the elastic member is housed.

15. The electromagnetic switch device for a starter according to claim 14, further comprising a packing on an end surface of the terminal block at the opening side at which the auxiliary relay is located, wherein the electromagnetic switch device for a starter has a structure in which an internal wire and the auxiliary relay located in the terminal block are held among the terminal block, the packing, and the cover.

16. The electromagnetic switch device for a starter according to claim 15, further comprising:

a connector transmitting the start signal to the auxiliary relay; and a liquid seal material adhered in a gap at a location where the connector is exposed to the outside in a state where the connector penetrates through the packing.

17. The electromagnetic switch device for a starter according to claim 13, further comprising a packing on an end surface of the terminal block at the opening side at which the auxiliary relay is located, wherein the electromagnetic switch device for a starter has a structure in which an internal wire and the auxiliary relay located in the terminal block are held among the terminal block, the packing, and the cover.

18. The electromagnetic switch device for a starter according to claim 17, further comprising:

a connector transmitting the start signal to the auxiliary relay; and a liquid seal material adhered in a gap at a location where the connector is exposed to the outside in a state where the connector penetrates through the packing.

19. The electromagnetic switch device for a starter according to claim 1, further comprising a packing on an end surface of the terminal block at the opening side at which the auxiliary relay is located, wherein the electromagnetic switch device for a starter has a structure in which an internal wire and the auxiliary relay located in the terminal block are held among the terminal block, the packing, and the cover.

20. The electromagnetic switch device for a starter according to claim 19, further comprising:

a connector transmitting the start signal to the auxiliary relay; and a liquid seal material adhered in a gap at a location where the connector is exposed to the outside in a state where the connector penetrates through the packing.

* * * * *